US006369762B1

(12) United States Patent
Yanagisawa et al.

(10) Patent No.: US 6,369,762 B1
(45) Date of Patent: Apr. 9, 2002

(54) FLAT ANTENNA FOR CIRCULARLY-POLARIZED WAVE

(75) Inventors: Wasuke Yanagisawa; Ryo Horie; JunXiang Ge, all of Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 09/756,679

(22) Filed: Apr. 26, 2001

(51) Int. Cl.[7] ..... H01Q 1/38

(52) U.S. Cl. ..... 343/700 MS; 343/895; 343/846

(58) Field of Search ..... 343/700 MS, 702, 343/846, 850, 853, 895; H01Q 1/38, 1/24

(56) References Cited

U.S. PATENT DOCUMENTS 5,903,240 A * 5/1999 Kawahata et al. ... 343/700 MS 5,943,019 A * 8/1999 Kawahata et al. ... 343/700 MS

* cited by examiner

*Primary Examiner*—Hoanganh Le
(74) *Attorney, Agent, or Firm*—Morgan, Lewis & Bockius LLP

(57) ABSTRACT

A ground conductor plane 1 and an excitation electrode 2 are provided substantially in parallel with each other. Two electrodes 3*a* and 3*b* for respectively radiating a linearly-polarized wave are provided substantially in parallel with the ground conductor plane 1, with the excitation electrode 2 interposed therebetween. The radiation electrodes are provides in close proximity to the excitation electrode 2 such that one end of each of the radiation electrodes 3*a* and 3*b* establishes capacitive coupling with respect to the excitation electrode 2. The other ends of each of the radiation electrodes 3*a* and 3*b* are grounded such that the directions in which electric fields are to be excited becomes substantially orthogonal to each other. For instance, a feeding section 4 is provided in flush with the ground conductor plane 1 and is electrically connected to the excitation electrode 2 via a feeding electrode 5.

21 Claims, 5 Drawing Sheets

FLAT ANTENNA FOR CIRCULARLY-POLARIZED WAVE

BACKGROUND OF THE INVENTION

The present invention relates to a compact, flat antenna for a circularly-polarized wave which is suitable for use in surface mounting. More particularly, the present invention relates to a compact plane antenna for a circularly-polarized wave which enables transmission and reception of a circularly-polarized wave without use of a special feeding circuit.

A dominant-mode patch antenna is often used as a flat antenna of this type for a circularly-polarized wave. As shown in FIGS. 7A and 7B, the antenna of this structure comprises a ceramic substrate 21 serving as a dielectric substrate, and a patch antenna element 22 provided on the surface of the ceramic substrate 21. Further, a ground conductor 23 is provided on the side of the ceramic substrate 21 opposite to the side where the patch antenna element 22 is disposed. A feeding pin 24 is connected to a feeding section 22*a* provided on the reverse side of the patch antenna element 22, by way of a through hole formed in the ceramic substrate 21 and that formed in the ground conductor 23. In principle, in the dominant-mode patch antenna, two sides A, which are orthogonal to each other within a plane, must be formed to an electrical length of substantially ½ wavelength. In order to make the dominant-mode patch antenna compact, a dielectric substrate having a large dielectric constant must be used as the dielectric substrate 21. Provided that the relative dielectric constant of the dielectric substrate 21 is taken as $\epsilon_r$, the length of one side A can be shortened in proportion to $\epsilon_r^{-1/2}$. For example, a GPS vehicle-mounted receiving terminal has been reduced to about one-fifth the size of a receiving terminal which is embodied without use of a substrate of high dielectric constant (one side is reduced to a size of about 20 to 25 mm).

However, in applications involving use of a small communications device, such as a portable receiving terminal, demand has existed for a smaller and less weight antenna whose size is about one-quarter that of a recently-available antenna (which has a side of about 5 mm and is one-twentieth the size of an antenna not provided with a substrate having a high dielectric constant). Even when an attempt is made to embody such an antenna by means of increasing the dielectric constant of the substrate in the manner as mentioned above, difficulty is encountered in matching a resonance frequency, due to limitations imposed by manufacturing technology. Producing a high-dielectric substrate having $\epsilon_r$ of 100 or more from low-loss material is difficult, because of limitations imposed by material.

An inverted-F-type antenna has hitherto been known as a related technique for miniaturizing a flat antenna for a linearly-polarized wave. The inverted-F-type antenna is formed as follows: Of two segments of an L-shaped conductive line (or plate), an open end of a shorter segment is grounded, and a longer segment is situated in parallel with the ground. Further, a feeding segment serving as a third conductor is placed substantially in parallel with and spaced apart from the shorter segment so as to satisfy requirements for impedance matching, as required. The feeding segment is formed from a conductive line (or plate) for connecting a power feeding point and the longer segment.

As shown in FIGS. 8A and 8B, a conductive film is formed so as to extend from one surface to a side surface of the substrate 21, thereby forming an L-shaped conductor (radiator element 22). The open end of the conductive film provided on the side surface (serving as a shorter segment) is connected to a ground conductor 23 provided on the reverse side of the substrate 21. A feeding pin 24 is connected to a feeding section 22*a* of the radiator element 22 by way of a through hole formed in the substrate 21 and that formed in the ground conductor 23. In this structure, a longer side B of the conductive film (i.e., the radiator element 22) provided on one surface of the substrate 21 can in principle be formed so as to assume an electrical length of substantially ¼ wavelength. The F-shaped antenna can be reduced to half the length of the dominant-mode patch antenna.

As mentioned above, a very compact antenna for a circularly-polarized wave required for a recent portable terminal, such as a small communications device, cannot be formed from the dominant-mode patch antenna.

On the other hand, the inverted-F-type antenna is to be used for a linearly-polarized wave. If an attempt is made to construct an antenna for a circularly-polarized wave from an inverted-F-type antenna, two independent inverted-F-type antenna elements must be provided orthogonal to each other within a plane. Furthers there must be employed a special feeding circuit, such as a 3*d*B hybrid link, for making the amplitudes of feed signals to be sent to the antenna elements equal, as welt as for making the phase of one feed signal orthogonal to that of the other feed signal. As a result, the antenna cannot be made compact, which in turn imposes an impediment to productivity.

SUMMARY OF THE INVENTION

The present invention has been conceived to solve the drawbacks of the related antennas, and it is therefore an object of the invention to provide a very compact antenna for a circularly-polarized wave which can be mounted on a compact portable terminal, such as a compact communications device.

Further, it is another object of the invention to provide a compact antenna for a circularly-polarized wave to be used with a compact communications device, the antenna being able to transmit and receive both a right-handed circularly-polarized wave and a left-handed circularly-polarized wave.

In order to achieve the above objects, according to the present invention, there is provided an antenna for a circularly-polarized wave comprising:

- a ground conductor plane;
- an excitation electrode provided substantially in parallel with the ground conductor plane;
- a pair of electrodes for radiating a linearly-polarized wave which are provided substantially in parallel with the ground conductor plane, with the excitation electrode interposed therebetween; and
- a feeding section electrically connected to the excitation electrode,
  - wherein first ends of the respective radiation electrodes oppose to the excitation electrode, thereby constituting capacitive coupling; and wherein second ends of the respective radiation electrodes are connected to the ground conductor plane such that the directions in which electric fields are to be excited become substantially orthogonal to each other.

In this configuration, two electrodes for respectively radiating a linearly-polarized wave are constructed so as to cause excitation independently of the excitation electrode in a non-contact manner. Hence, the two radiation electrodes can be simultaneously excited so as to be electrically independent of each other. Hence, the compact antenna can transmit and receive a circularly-polarized wave without involvement of equal distribution of power or without use of a special feeding circuit for realizing a 90-degrees phase shift.

Preferably, an electrical length of each of the radiation electrodes should be substantially quarter wavelength of a desired frequency band. If each of the radiation electrodes is provided so as to extend from the first end to the second end in a meandering manner, a longer electrical length per unit dimension can be ensured, thereby rendering the radiation electrodes more compact.

Alternatively, each of the radiation electrodes extending from the first end may be folded at least once toward the first end so as to be able to cause resonation at two frequency bands. In this configuration, the antenna can transmit and receive signals of two frequency bands: that is, a signal of first frequency and a signal of second frequency which is about double the first frequency band.

Preferably, a dielectric member is interposed between the ground conductor plane, the excitation electrode, and the radiation electrodes. If the dielectric constant of the dielectric member is increased, the radiation electrodes can be made more compact.

Here, it is preferable that the dielectric member is a dielectric substrate. The excitation electrode and the radiation electrodes are provided on a first surface of the dielectric substrate, and the ground conductor plane and the feeding section are provided on a second surface of the dielectric substrate parallel to the first surface. A conductive film for electrically connecting the second ends of the radiation electrodes and the ground conductor plane, and a conductive film for electrically connecting the excitation electrode and the feeding section are formed on the side surfaces of the dielectric substrate. In this configuration, the antenna can be produced readily, and use of a substrate having a larger dielectric constant enables a further reduction in the size of the dielectric substrate.

Here, it is preferable that the excitation electrode has two equal-length sides orthogonal to each other. Each of the radiation electrodes is a strip-shaped member formed with a shorter side section constituting the first and second ends and a longer side section. The shorter side sections at the first ends of the respective radiation electrodes oppose to the two equal-length sides of the excitation electrode substantially in parallel with each other.

Alternatively, it is preferable that the excitation electrode is a conductor piece having two opposing sides which are substantially parallel with each other. Each of the radiation electrodes is a strip-shaped member formed with a shorter side section constituting the first and second ends and a longer side section. The shorter sides of the first ends oppose to substantially in parallel with the two opposing sides of the excitation electrode while making an angle of 45 degrees with respect to the respective longer sides.

Here, the "strip-shaped member" means a conductor piece having a side opposing the excitation electrode and sides longer than the side. The strip-shaped member includes a conductor piece which is folded into a zigzag pattern in the direction perpendicular to the longer sides (or the direction in which the conductor piece is to extend), and a conductor piece folded in the direction parallel to the direction in which the conductor pieces is to be extended. Further, the strip-shaped member can include a plate-shaped conductor piece, a conductive film, and a conductor line.

Preferably, the dielectric substrate is formed so as to assume a first arm section and a second arm section, which are orthogonal to each other. The pair of radiation electrodes are provided on at least respective first and second arm sections. In this configuration, the dielectric substrate can be made more compact.

Preferably, the antenna further comprises a second pair of electrodes for radiating a second linearly-polarized wave. One of the two pairs of electrodes is used for a right-handed circularly-polarized wave, and the other is used for a left-handed circularly-polarized wave.

Preferably, the excitation electrode is a conductor piece having two opposing sides which are substantially parallel with each other at a comer of the dielectric substrate. A corner portion of a side surface of the dielectric substrate is chamfered in a direction orthogonal to the two opposing sides of the excitation electrode. The conductive film is formed in the chamfered section.

DETAILED DESCRIPTION OF THE PREFERRED EMBODIMENTS

An antenna for a circularly-polarized wave (hereinafter referred to simply as "antenna") according to the present invention will now be described by reference to the accompanying drawings. As can be seen from an illustrative rendering provided in FIG. 1A, which rendering shows the construction of the antenna according to a first embodiment of the present invention, an excitation electrode 2 is provided substantially in parallel with a ground conductor plane 1. Two electrodes 3*a* and 3*b* for radiating a linearly-polarized wave (hereinafter referred to as "radiation electrodes") are provided substantially in parallel with the ground conductor plane 1, with the excitation electrode 2 interposed therebetween. One end of the radiation electrode 3*a* is provided close to the excitation electrode 2 so as to establish capacitive coupling with the same. Similarly, one end of the radiation electrode 3*b* is provided close to the excitation electrode 2 so as to establish capacitive coupling with the same. The remaining end of the radiation electrode 3*a* and that of the radiation electrode 3*b* are grounded. Further, the radiation electrodes 3*a* and 3*b* are arranged such that an exciting direction of electric field in the radiation electrode 3*a* becomes substantially orthogonal to that in the electrode 3*b*.In the examples shown in FIGS. 1A through 1C, a feeding section 4 is provided in an identical plane with the ground conductor plane 1. The feeding section 4 is electrically connected to the excitation electrode 2 by way of a feeding electrode 5. FIG. 1B is a perspective and illustrative rendering of the antenna when viewed from the reverse side of FIG. 1A, and FIG. 1C is an illustrative bottom rendering.

Figure 1A:
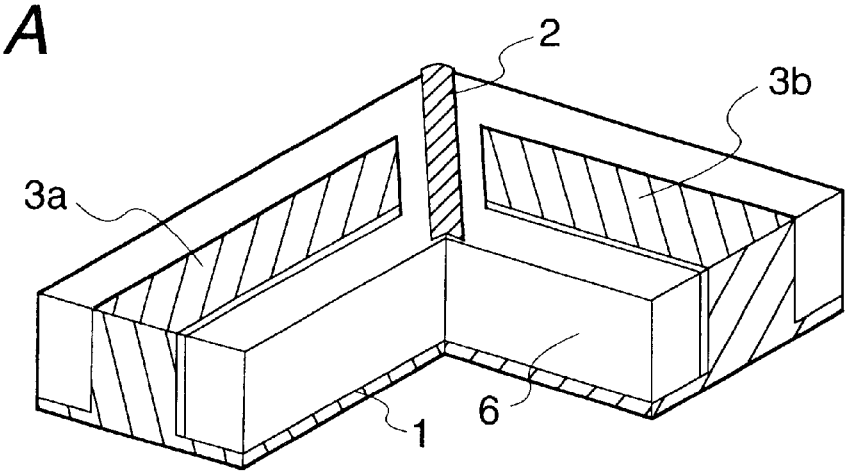
FIGS. 1A through 1C are illustrative renderings of a flat antenna according to a first embodiment of the present invention.
Figure 1B:
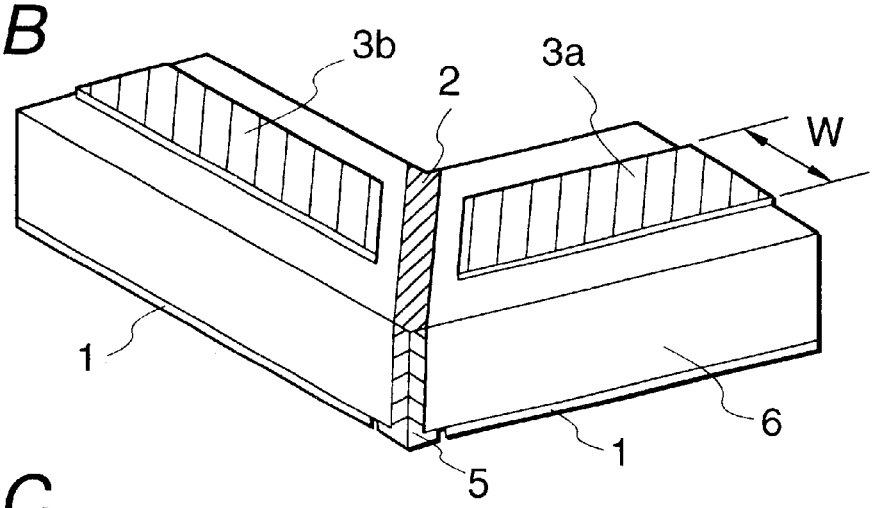
Figure 1C:
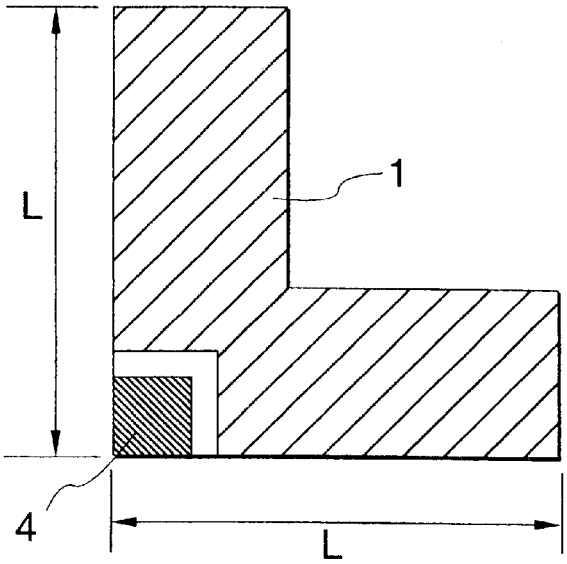

In the examples shown in FIGS. 1A through 1C, the radiation electrodes formed on one surface of a dielectric substrate 6 and the ground conductor plane 1 provided on the other side of the dielectric substrate 5 are formed from a conductive film. The ground conductor plane 1 and the radiation electrodes 3*a* and 3*b* can be readily formed on the dielectric substrate 6 by means of printing or a like technique. For example, they can be formed by means of providing a conductive film on either side of the dielectric substrate 6 and patteming the conductive films through etching. The antenna according to the present invention is not limited to this construction. The ground conductor plane 1, the excitation electrode 2, and the radiation electrodes 3*a* and 3*b* may be provided substantially in parallel with each other by way of space. A ceramic substrate, for example, can be used for the dielectric substrate 6. The greater the dielectric constant of material, the smaller the radiation electrodes 3*a* and 3*b*. For instance, $BaO—TiO_2—SnO_2$ and $MgO—CaO—TiO_2$, which have a relative dielectric constant of about 30 or more, are preferable.

As mentioned, a conductive film, such as a silver film, is preferable, because the ground conductor plane 1, the excitation electrode 2, and the radiation electrodes 3*a* and 3*b* can be formed readily, by means of printing a conductive film on the dielectric substrate 6. However, the antenna according to the present invention is not limited to this example. A conductive line or conductor plate, such as copper, may be provided on the dielectric substrate 6 or sustained in space. The width W of each of the radiation electrodes 3*a* and 3*b* is smaller than the length L of the same. The width W is determined in accordance with a desired band characteristic. Each of the radiation electrodes 3*a* and 3*b* is formed such that the length L (i.e., the length of an electrode extending from the excitation electrode 2) becomes an electrical length of ¼ wavelength (λ). The physical length of each of the radiation electrodes 3*a* and 3*b* can be shortened in proportion to $\epsilon_r^{-1/2}$, by means of controlling the relative dielectric constant $\epsilon_r$ of the dielectric substrate 1.

One end of each of the radiation electrodes 3*a* and 3*b* opposes the excitation electrode 2. In the examples shown in FIGS. 1A through 1C, the excitation electrode 2 is formed as a strip-shaped member having two parallel sides. The radiation electrodes 3*a* and 3*b* are provided in close proximity to the respective parallel sides. A shorter side at one end of each of the strip-shaped radiation electrodes 3*a* and 3*b* forms an angle of substantially 45 degrees with respect to the corresponding longer side. As a result, the two radiation electrodes 3*a* and 3*b* meet at a right angle, with the excitation electrode 2 interposed therebetween.

The area at which the radiation electrodes 3*a* and 3*b* meet with the excitation electrode 2 interposed therebetween constitutes capacitive coupling. The degree of coupling can be changed by adjusting the gaps between the radiation electrodes 3*a* and 3*b* and the excitation electrode 2. Hence, the distribution ratio of the power supplied to the radiation electrode 3*a* to the power supplied to the radiation electrode 3*b* can be freely adjusted.

The resonance frequency of each of the radiation electrodes 3*a* and 3*b* can be freely adjusted, by changing the length (electrical length) L of each of the radiation electrodes 3*a* and 3*b*. So long as the resonance frequency of either of the radiation electrodes 3*a* and 3*b* is shifted upward relative to the center frequency to be used, and the resonance frequency of the remaining radiation electrode is shifted downward relative to the same, as required, the phase of electromagnetic wave originating from the radiation electrode 3*a* can be shifted from the phase of the electromagnetic wave originating from the radiation electrode 3*b*. The resonance frequencies of the radiation electrodes 3*a* and 3*b* are adjusted such that a 90-degrees phase shift arises between the electromagnetic waves. More specifically, a circularly-polarized wave can be transmitted and received through use of the radiation electrodes 3*a* and 3*b* for a linearly-polarized wave and without use of a special feeding circuit, by adjusting the length of the radiation electrodes 3*a* and 3*b* and the degree of coupling between the radiation electrodes 3*a* and 3*b* (i.e., the gaps between the excitation electrode 2 and the radiation electrodes 3*a* and 3*b*).

In the examples shown in FIGS. 1A through 1C, the other end of the radiation electrode 3*a* and that of the radiation electrode 3*b* are electrically connected directly to the ground conductor plane 1 by way of the respective side surfaces of the dielectric substrate 6. In the examples shown in FIGS. 1A through 1C, the ground conductor plane 1 is formed slightly larger than the radiation electrodes 3*a* and 3*b*. Alternatively, the ground conductor plane 1 may be omitted, and the other end of each of the radiation electrodes 3*a* and 3*b* may be provided directly on a ground plane of much greater size.

Figure 7A:
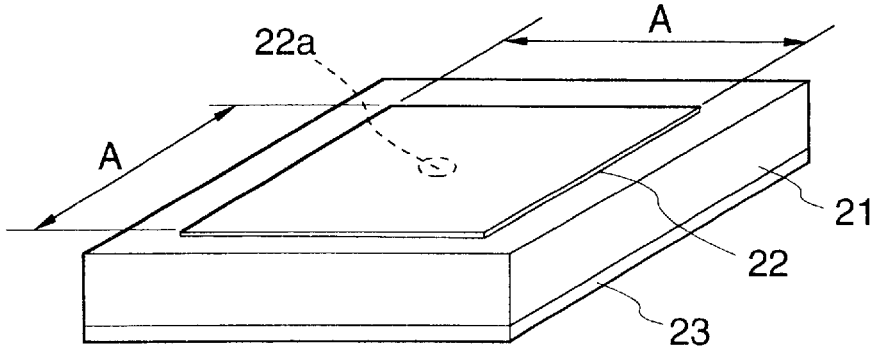
FIGS. 7A and 7B are illustrative renderings of a relevant dominant-mode patch antenna.
Figure 7B:
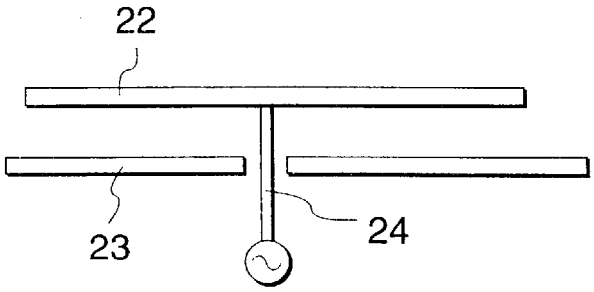
Figure 8A:
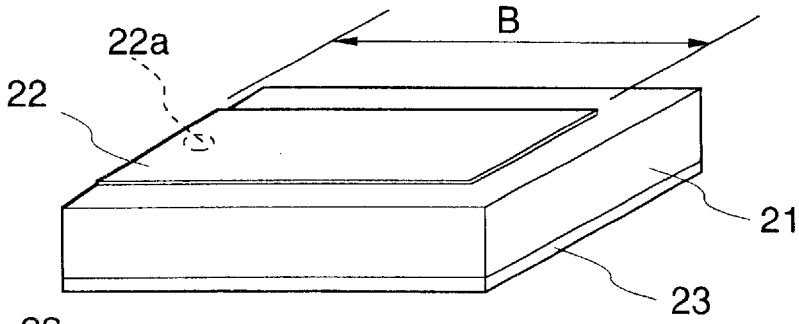
FIGS. 8A and 8B are illustrative renderings of a relevant inverted-F-type antenna.
Figure 8B:
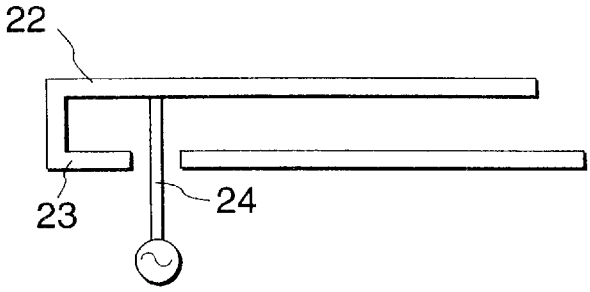

In the examples shown in FIGS. 1A through 1C, the feeding section 4 is provided on the reverse side of the dielectric substrate 6 so as to be flush with the ground conductor plane 1 and is electrically connected to the excitation electrode 2 by way of the feeding electrode 5 provided on the side of the dielectric substrate 6. As in the case of the feeding manner shown in FIGS. 7B and 8B, the feeding section 4 may be provided at a position lower than the ground conductor plane 1 by way of a through hole formed in the dielectric substrate 6 and that formed in the ground conductor plane 1. In this case, the feeding section 4 may be connected to the ground conductor plane 1 via a coaxial line. Alternatively, a strip line provided on another substrate may be connected to the feeding section 4.

Next will be described the operation of the antenna. First, transmission operation of the antenna will be described. Receiving operation is totally identical with transmission operation, except that receiving operation is the reverse of transmission operation. A signal input to the feeding section 4 forms a standing wave in the excitation electrode 2 by way of the feeding electrode 5. The voltage of the standing wave becomes higher toward the tip end of the excitation electrode 2. The standing wave is capacitively coupled to respective ends of the radiation electrodes 3*a* and 3*b*, thereby exciting them. The radiation electrodes 3*a* and 3*b* are set to an electrical length close to λ/4. Hence, the thus-coupled signal produces a standing wave which exhibits maximum voltage at an open end (one end) and maximum current at a grounded end (the other end) of each of the radiation electrodes 3*a* and 3*b*. Thus, the antenna can efficiently emanate a coupled signal as a λ/4 inverted-L-type antenna.

The radiation electrodes 3*a* and 3*b* are connected independently to the excitation electrode 2. Hence, the resonance characteristics of the radiation electrodes 3*a* and 3*b* are sustained substantially independently. As mentioned previously, the electrical length of the radiation electrode 3*a*, that of the radiation electrode 3*b*, the gap between the radiation electrode 3*a* and the excitation electrode 2, and the gap between the radiation electrode 3*b* and the excitation electrode 2 are adjusted such that a 90-degrees phase shift exists between the electromagnetic waves originating from the radiation electrodes 3*a* and 3*b*. Further, the two radiation electrodes 3*a* and 3*b* are arranged at an angle of 90 degrees. Two linearly-polarized waves which are equal in power and 90-degrees out of phase with each other are radiated simultaneously, thereby radiating a circularly-polarized wave.

Figure 2A:
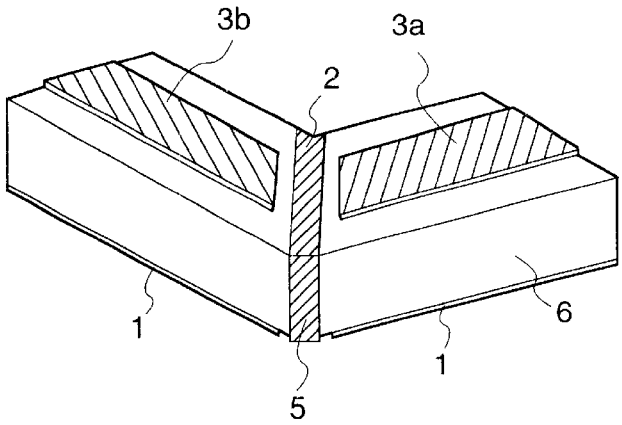
FIGS. 2A and 2B are illustrative renderings of a flat antenna according to a second embodiment of the present invention.
Figure 2B:
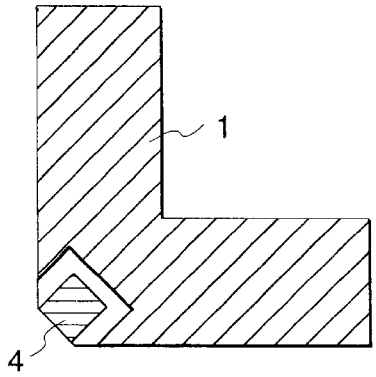

FIGS. 2A and 2B show an antenna for a circularly-polarized wave according to a second embodiment of the present invention. FIG. 2A is similar to FIG. 1B, showing a perspective view of the antenna. FIG. 2B is similar to FIG. 1C, showing a bottom view of the antenna. In this example, the corner of the dielectric substrate 6 is chamfered at right angles to the direction in which the excitation electrode 2 extends. A conductive film is printed on the thus-chamfered section, thereby forming the feeding electrode 5. In the examples shown in FIGS. 1A through 1C, a conductive film must be printed on two side surfaces of the dielectric substrate 6. In contrast, in the present embodiment, so long as at the time of formation of the dielectric substrate 6 a chamfered section is formed at an area where the feeding electrode 5 is to be formed, the feeding electrode 5 can be formed by a single printing operation, thereby improving productivity.

Figure 3A:
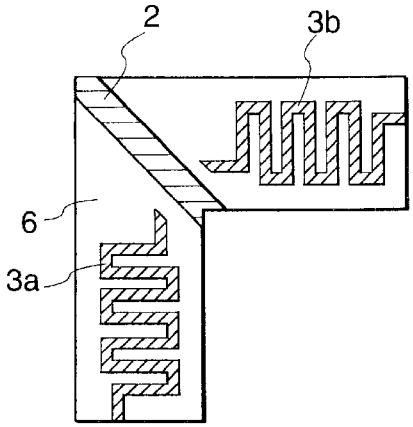
FIG. 3A is an illustrative rendering of a flat antenna according to a third embodiment of the present invention.

FIG. 3A shows an antenna for a circularly-polarized wave according to a third embodiment of the present invention.

In the first and second embodiments, the electrodes 3*a* and 3*b* are formed into linear strips. In this embodiment, as shown in FIG. 3A, the radiation electrodes 3*a* and 3*b* may be formed into zigzag or meandering strips. Such a meandering shape ensures a longer electrical length per unit dimension. Hence, the antenna can be miniaturized further. In the drawings, those elements which are identical with those elements shown in FIGS. 1A through 1C are assigned the same reference numerals, and repetition of their explanations is omitted.

Figure 3B:
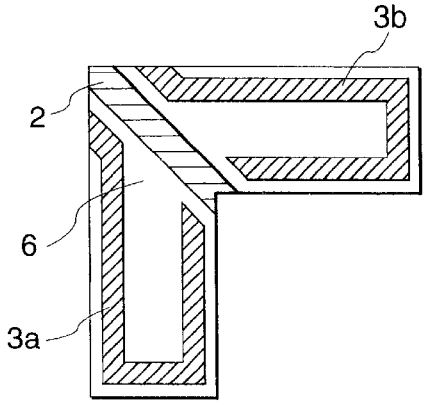
FIG. 3B is an illustrative rendering of a flat antenna according to a fourth embodiment of the present invention.

In a fourth embodiment shown in FIG. 3B, the radiation electrodes 3*a* and 3*b* are folded in the direction in which the strips extend. By folding the strips in their longitudinal directions (i.e., the directions in which the strips are to extend), electrical connection between adjacent elements becomes feasible. By controlling the number of folds or the gap between adjacent elements, the antenna becomes able to transmit and receive two frequency bands, one frequency band being substantially double the other frequency band. For example, the antenna acts as a ¼ wavelength antenna for a first frequency band and as a ¾ wavelength antenna for a second frequency band which is about double the first frequency band. Thus, the antenna can cope with two frequency bands. Such a folded construction enables changing of an area over which the radiation electrodes are coupled with the excitation electrode, thus changing a transmission/reception frequency. In other respects, the antenna is identical with that shown in FIGS. 1A through 1C.

Figure 3C:
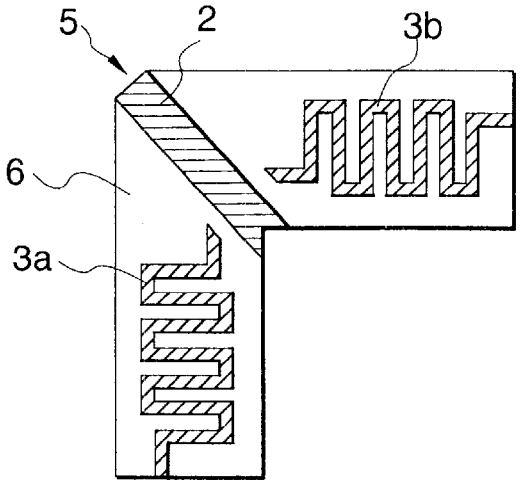
FIG. 3C is an illustrative rendering of a flat antenna according to a fifth embodiment of the present invention.
Figure 3D:
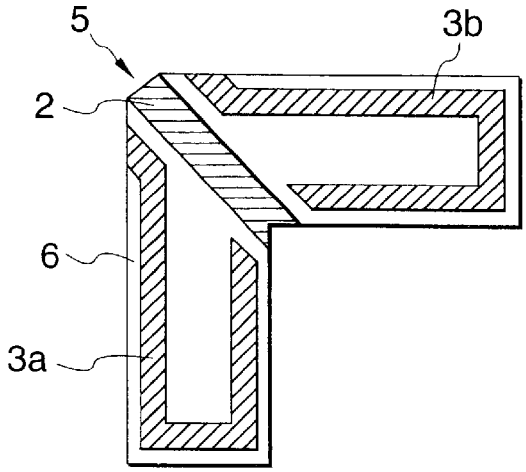
FIG. 3D is an illustrative rendering of a flat antenna according to a sixth embodiment of the present invention.

FIGS. 3C and 3D show examples similar to the second embodiment, in which it is chamfered a boundary at which two side surfaces of the dielectric substrate 6 meet and at which the feeding electrode 5 is to be formed, in the third and fourth embodiments shown in FIGS. 3A and 3B. The reverse side of each of the antennas on which the ground conductor plane 1 and the feeding section 4 are provided is identical in construction with that shown in FIG. 2B, and hence repeated explanation is omitted. As in the case of the second embodiment, a conductive film is printed on the chamfered section, thereby forming the feeding electrode 5.

Figure 4:
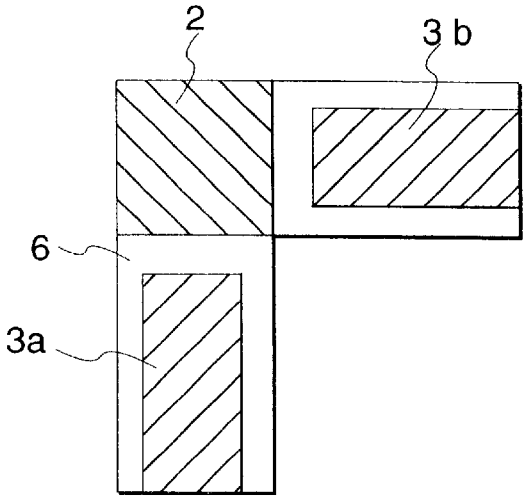
FIG. 4 is an illustrative rendering of a flat antenna according to a seventh embodiment of the present invention.

An antenna shown in FIG. 4 is an example in which the geometry of the excitation electrode 2 is changed. In this example, the excitation electrode 2 is not a rectangular shape whose two side oppose the radiation electrodes 3*a* and 3*b* at an angle of 45 degrees with respect to the directions in which the radiation electrodes 3*a* and 3*b* extend; rather, the excitation electrode 2 is formed such that two sides oppose the corresponding radiation electrodes 3*a* and 3*b* at a right angle with respect to the directions in which the electrodes 3*a* and 3*b* extend. More specifically, the excitation electrode 2 is formed such that the sides of the excitation electrode 2 opposing the corresponding radiation electrodes 3*a* and 3*b* assume two equal-length sides which are orthogonal to each other. Even in this geometry, as in the case of the previous examples, the two radiation electrodes 3*a* and 3*b* can be excited independently. In other respects, the antennas are identical with that shown in FIGS. 1A through 1C, and repeated explanation is omitted.

Figure 5:
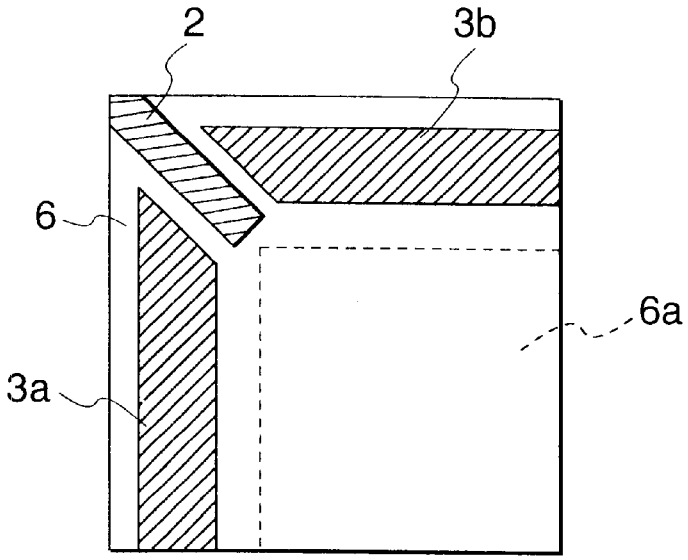
FIG. 5 is an illustrative rendering of a flat antenna according to an eighth embodiment of the present invention.

FIG. 5 is an example antenna in which the area of the dielectric substrate 6 other than the radiation electrodes 3*a* and 3*b* remains unremoved. In the examples shown in FIGS. 1A through 4, an area 6*a* surrounded by dashed lines, as shown in FIG. 5, is removed from the dielectric substrate 6, thereby rendering the antennas compact. However, the area 6*a* may be left as is. In such a case, the ground conductor plate 1 provided on the reverse side of the dielectric substrate 6 may be left over the entire surface of the reverse side or may remain removed.

Figure 6:
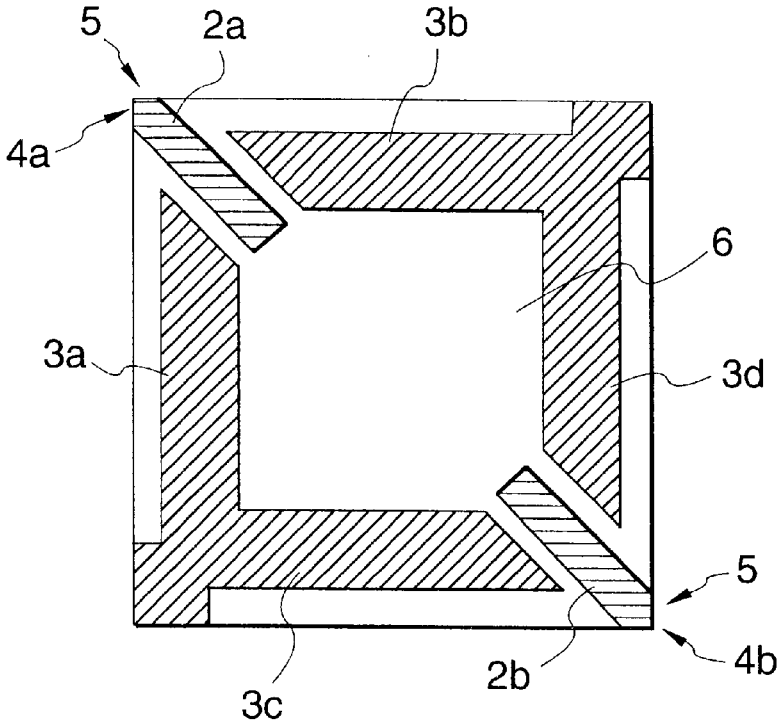
FIG. 6 is an illustrative rendering of a flat antenna according to a ninth embodiment of the present invention.

FIG. 6 shows an antenna comprising two pairs of radiation electrodes; that is, a set consisting of the radiation electrodes 3*a* and 3*b* and another set consisting of radiation electrodes 3*c* and 3*d*. For example, one electrode set may be used for a right-handed circularly-polarized wave, and another electrode set may be used for a left-handed circularly-polarized wave. By switching between feeding sections 4*a* and 4*b* through use of a circuit switcher, the antenna can transmit and receive both the right-handed circularly-polarized wave and the left-handed circularly-polarized wave. According to such a construction, the remaining section of the dielectric substrate 6 can be effectively utilized, thereby enabling effective transmission and receipt of both the right-handed circularly-polarized wave and the left-handed circularly-polarized wave.

Although not all possible examples are illustrated, the feeding electrode 5 is provided on each of the antennas shown in FIGS. 4 through 6, as in the case of the antennas shown in FIGS. 3A and 3B. A chamfered section is formed in a boundary section between the two adjacent side surfaces of the dielectric substrate 6, and a conductive film is printed on the chamfered section, thereby enabling formation of the feeding electrode 5.

According to the present invention, two radiation electrodes of ¼ wavelength type are electrically excited simultaneously by a single excitation electrode, in a non-contacting manner and electrically independently. As a result, there can be effected distribution of signals of equal power with a 90-degrees phase shift, thereby enabling formation of a circularly-polarized wave without use of a special feeding circuit. The required area of the antenna according to the present invention can be reduced to one-fourth to one-eighth (when undesired portions are removed)

that of the antenna using a dielectric substrate identical with that used for the related patch antenna. Thus, a good circularly-polarized wave characteristic can be realized, along with a further reduction in the size, weight, and cost of an antenna required for use of portable terminals.

The present invention can be implemented in various forms without departing from the principle and primary characteristics of the present invention. In all respects, the previously-described embodiments are merely illustrative and should not be interpreted restrictively. The scope of the present invention is described by appended claims and is not restrained by the descriptions of the specification. All modifications and alterations belonging to the scope of equivalence of the claims fall within the range of the present invention.

What is claimed is:

1. An antenna for a circularly-polarized wave, comprising:

a ground conductor plane;

an excitation electrode provided substantially in parallel with the ground conductor plane;

a pair of electrodes for radiating a linearly-polarized wave which are provided substantially in parallel with the ground conductor plane, with the excitation electrode interposed therebetween; and a feeding section electrically connected to the excitation electrode, wherein first ends of the respective radiation electrodes oppose to the excitation electrode, thereby constituting capacitive coupling, and second ends of the respective radiation electrodes are connected to the ground conductor plane; and wherein the respective radiation electrodes are arranged such that the directions in which electric fields are to be excited become substantially orthogonal to each other.

2. The antenna as set forth in claim 1, wherein an electrical length of each of the radiation electrodes is substantially quarter wavelength of a center frequency of a receive frequency band.

3. The antenna as set forth in claim 1, wherein each of the radiation electrodes is provided so as to extend from the first end to the second end in a meandering manner.

4. The antenna as set forth in claim 1, wherein each of the radiation electrodes extending from the first end is folded at least once toward the first end so as to be able to cause resonation at two frequency bands.

5. The antenna as set forth in claim 1, wherein a dielectric member is interposed between the ground conductor plane, the excitation electrode, and the radiation electrodes.

6. The antenna as set forth in claim 5, wherein the dielectric member is a dielectric substrate;

wherein the excitation electrode and the radiation electrodes are provided on a first surface of the dielectric substrate, and the ground conductor plane and the feeding section are provided on a second surface of the dielectric substrate parallel to the first surface; and wherein a conductive film for electrically connecting the second ends of the radiation electrodes and the ground conductor plane, and a conductive film for electrically connecting the excitation electrode and the feeding section are formed on the side surfaces of the dielectric substrate.

7. The antenna as set forth in claim 6, wherein the pair of radiation electrodes are arranged on the first surface of the dielectric substrate substantially at an angle of 90 degrees; and wherein the ground conductor plane is formed in a position on the second surface of the dielectric substrate so as to oppose to at least the pair of radiation electrodes.

8. The antenna as set forth in claim 6, wherein the excitation electrode is a conductor piece having two opposing sides which are substantially parallel with each other at a corner of the dielectric substrate;

wherein a corner portion of a side surface of the dielectric substrate is chamfered in a direction orthogonal to the two opposing sides of the excitation electrode; and wherein the conductive film is formed in the chamfered section.

9. The antenna as set forth in claim 1, wherein the excitation electrode has two equal-length sides orthogonal to each other;

wherein each of the radiation electrodes is a strip-shaped member formed with a shorter side section constituting the first and second ends and a longer side section; and wherein the shorter side sections at the first ends of the respective radiation electrodes oppose to the two equal-length sides of the excitation electrode substantially in parallel with each other.

10. The antenna as set forth in claim 1, wherein the excitation electrode is a conductor piece having two opposing sides which are substantially parallel with each other;

wherein each of the radiation electrodes is a strip-shaped member formed with a shorter side section constituting the first and second ends and a longer side section; and wherein the shorter sides of the first ends oppose to substantially in parallel with the two opposing sides of the excitation electrode while making an angle of 45 degrees with respect to the respective longer sides.

11. The antenna as set forth in claim 1, further comprising a second pair of electrodes for radiating a second linearly-polarized wave, wherein one of the two pairs of electrodes is used for a right-handed circularly-polarized wave, and the other is used for a left-handed circularly-polarized wave.

12. An antenna for a circularly-polarized wave, said antenna comprising:

a ground conductor plane;

an excitation electrode provided substantially in parallel with the ground conductor plane;

a pair of electrodes for radiating a linearly-polarized wave which are provided substantially in parallel with the ground conductor plane, with the excitation electrode interposed therebetween; and a feeding section electrically connected to the excitation electrode, wherein a dielectric member having at least one corner substantially orthogonal to said ground conductor plane is interposed between the ground conductor plane, the excitation electrode, and the radiation electrodes;

wherein the excitation electrode is located at one of said at least one corners of the dielectric member;

wherein first ends of the respective radiation electrodes oppose to the excitation electrode, thereby constituting capacitive coupling, and second ends of the respective radiation electrodes are connected to the ground conductor plane; and wherein the respective radiation electrodes are arranged such that the directions in which electric fields are to be excited become substantially orthogonal to each other.

13. The antenna as set forth in claim 12, wherein an electrical length of each of the radiation electrodes is substantially quarter wavelength of a center frequency of a receive frequency band.

14. The antenna as set forth in claim 12, wherein each of the radiation electrodes is provided so as to extend from the first end to the second end in a meandering manner.

15. The antenna as set forth in claim 12, wherein each of the radiation electrodes extending from the first end is folded at least once toward the first end so as to be able to cause resonation at two frequency bands.

16. The antenna as set forth in claim 12, wherein the dielectric member is a dielectric substrate;

wherein the excitation electrode and the radiation electrodes are provided on a first surface of the dielectric substrate, and the ground conductor plane and the feeding section are provided on a second surface of the dielectric substrate parallel to the first surface; and wherein a conductive film for electrically connecting the second ends of the radiation electrodes and the ground conductor plane, and a conductive film for electrically connecting the excitation electrode and the feeding section are formed on the side surfaces of the dielectric substrate.

17. The antenna as set forth in claim 16, wherein the pair of radiation electrodes are arranged on the first surface of the dielectric substrate substantially at an angle of 90 degrees; and wherein the ground conductor plane is formed in a position on the second surface of the dielectric substrate so as to oppose to at least the pair of radiation electrodes.

18. The antenna as set forth in claim 16, wherein the excitation electrode is a conductor piece having two opposing sides which are substantially parallel with each other at the corner of the dielectric substrate;

wherein the corner portion of a side surface of the dielectric substrate is chamfered in a direction orthogonal to the two opposing sides of the excitation electrode; and wherein the conductive film is formed in the chamfered section.

19. The antenna as set forth in claim 12, wherein the excitation electrode has two equal-length sides orthogonal to each other;

wherein each of the radiation electrodes is a strip-shaped member formed with a shorter side section constituting the first and second ends and a longer side section; and wherein the shorter side sections at the first ends of the respective radiation electrodes oppose to the two equal-length sides of the excitation electrode substantially in parallel with each other.

20. The antenna as set forth in claim 12, wherein the excitation electrode is a conductor piece having two opposing sides which are substantially parallel with each other;

wherein each of the radiation electrodes is a strip-shaped member formed with a shorter side section constituting the first and second ends and a longer side section; and wherein the shorter sides of the first ends oppose to substantially in parallel with the two opposing sides of the excitation electrode while making an angle of 45 degrees with respect to the respective longer sides.

21. The antenna as set forth in claim 12, further comprising a second pair of electrodes for radiating a second linearly-polarized wave, wherein one of the two pairs of electrodes is used for a right-handed circularly-polarized wave, and the other is used for a left-handed circularly-polarized wave.

* * * * *